US008746114B2

(12) United States Patent
Wu

(10) Patent No.: US 8,746,114 B2
(45) Date of Patent: Jun. 10, 2014

(54) ISOLATIVE TORQUE-EXERTING APPARATUS

(75) Inventor: Jih Chun Wu, Taichung (TW)

(73) Assignee: Matatakitoyo Tool Co., Ltd., Taichung (TW)

( * ) Notice: Subject to any disclaimer, the term of this patent is extended or adjusted under 35 U.S.C. 154(b) by 241 days.

(21) Appl. No.: 13/495,784

(22) Filed: Jun. 13, 2012

(65) Prior Publication Data

US 2013/0333529 A1 Dec. 19, 2013

(51) Int. Cl.

| | |
|---|---|
| ***B25B 23/14*** | (2006.01) |
| ***B25B 13/46*** | (2006.01) |
| ***B25G 1/12*** | (2006.01) |
| ***B25B 23/142*** | (2006.01) |

(52) U.S. Cl.

CPC ..... *B25B 13/461* (2013.01); *B25G 1/12* (2013.01); *B25B 23/1427* (2013.01); *B25B 23/1422* (2013.01)

USPC ..... 81/467; 81/180.1

(58) Field of Classification Search

USPC ..... 81/467, 180.1, 52, 473, 477, 478

See application file for complete search history.

(56) References Cited

U.S. PATENT DOCUMENTS

| | | | | |
|---|---|---|---|---|
| 8,408,103 | B2 * | 4/2013 | Wu | 81/467 |
| 2013/0081522 | A1 * | 4/2013 | Cook | 81/124.2 |

* cited by examiner

*Primary Examiner* — David B Thomas

(57) ABSTRACT

An isolative torque-exerting apparatus includes a wrench and two isolating elements. The wrench includes a head, a handle extending from the head, a switch placed on the head, an insert partially inserted in the head, a ring placed against the insert, a first ring connected to the head for keeping the ring in the head, and a second clip connected to the ring for keeping the insert partially in the head. The first isolating element includes a cap for wrapping the head, a skirt extending from the cap, and a sheath for wrapping the handle. The second isolating element includes a first drum placed in the skirt, a second drum for wrapping the insert, and an annular membrane extending from the first drum to the second drum for covering the ring and the clips.

4 Claims, 3 Drawing Sheets

ISOLATIVE TORQUE-EXERTING APPARATUS

BACKGROUND OF INVENTION

1. Field of Invention

The present invention relates to an isolative torque-exerting apparatus and, more particularly, to an isolative unit for a wrench.

2. Related Prior Art

Different hand tools are used for different purposes. Wrenches are often used to tighten or loose screws and nuts. Most wrenches are made of metal. Users might get electric shocks while working with such metal wrenches in environments where there are electrical elements.

Referring to FIG. 1, there is shown a conventional isolative torque-exerting apparatus including a wrench 10 and an isolating layer 20. The wrench 10 is made of metal generally and includes a head 11, a handle extending from the head 11, an insert 12 connected to a selective one-way mechanism placed in the head 11, a switch 13 connected to the selective one-way mechanism, and two clips 14 and 15 connected to the head 11 to keep the selective one-way mechanism in the head 11. The isolating layer 20 includes a skirt 22 extending from a cap 21. The cap 21 wraps the head 11. The skirt 22 extends around but does not contact the insert 12. In fact, the insert 12 extends beyond the skirt 22. The cap 21 does not interfere with the connection of the switch 13 to the head 11.

The use of the isolating layer 20 is not without problems. For example, the skirt 22 however interferes with the connection of the clip 15 to the head 11. It is difficult if not impossible to detach the clip 15 from the head 11. Hence, it is difficult if not impossible to maintain the selective one-way mechanism.

Furthermore, the portion of the insert 12 that extends beyond the skirt 22 may contact an electric element. Electricity may travel to the handle from the electric element via the insert 12, the selective one-way mechanism and the head 11. Hence, a user may get an electric shock while working with the handle in his or her hand.

Moreover, the clips 14 and 15 are exposed to dust, dirt, grease and/or water since they are not covered by the skirt 22. Hence, the selective one-way mechanism may be contaminated or damaged by the dust, dirt, grease and/or water traveling into the head 11 past the clips 14 and 15.

The present invention is therefore intended to obviate or at least alleviate the problems encountered in prior art.

SUMMARY OF INVENTION

It is the primary objective of the present invention to provide an effective isolative torque-exerting apparatus.

To achieve the foregoing objective, the isolative torque-exerting apparatus includes a wrench and two isolating elements. The wrench includes a head, a handle extending from the head, a switch placed on the head, an insert partially inserted in the head, a ring placed against the insert, a first ring connected to the head for keeping the ring in the head, and a second clip connected to the ring for keeping the insert partially in the head. The first isolating element includes a cap for wrapping the head, a skirt extending from the cap, and a sheath for wrapping the handle. The second isolating element includes a first drum placed in the skirt, a second drum for wrapping the insert, and an annular membrane extending from the first drum to the second drum for covering the ring and the clips.

Other objectives, advantages and features of the present invention will be apparent from the following description referring to the attached drawings.

BRIEF DESCRIPTION OF DRAWINGS

The present invention will be described via detailed illustration of the preferred embodiment versus the prior art referring to the drawings wherein.

DETAILED DESCRIPTION OF PREFERRED EMBODIMENT

Figure 1:
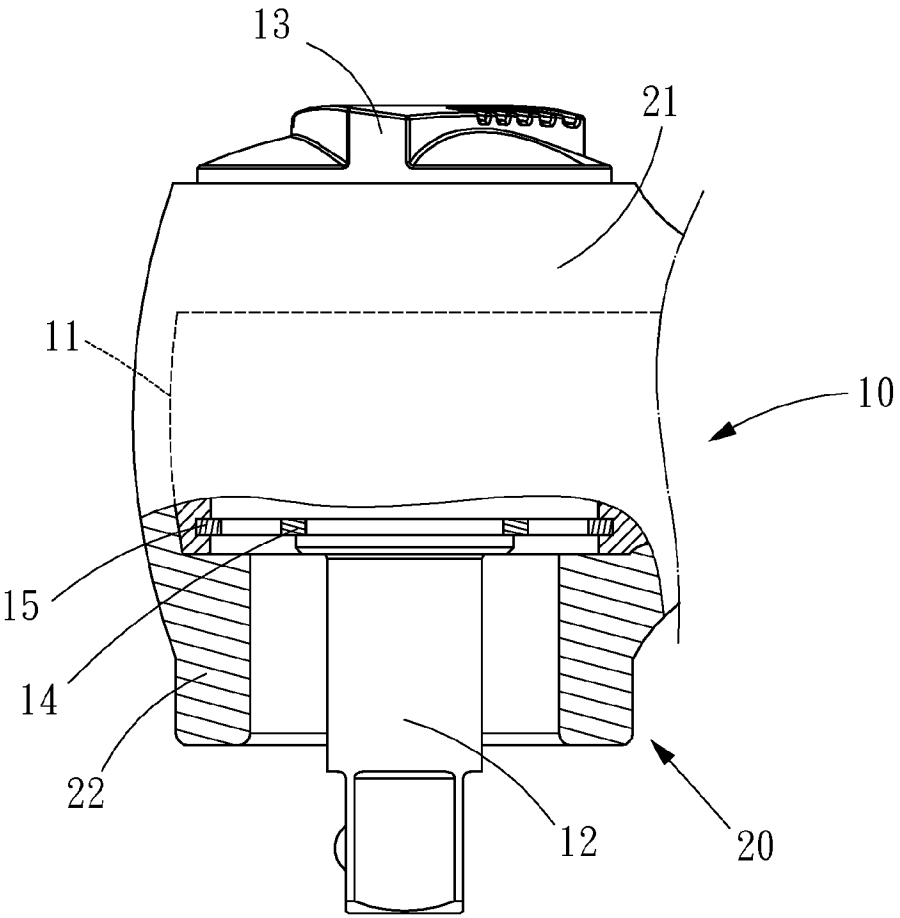
FIG. 1 is a cross-sectional view of a conventional isolative torque-exerting apparatus.
Figure 2:
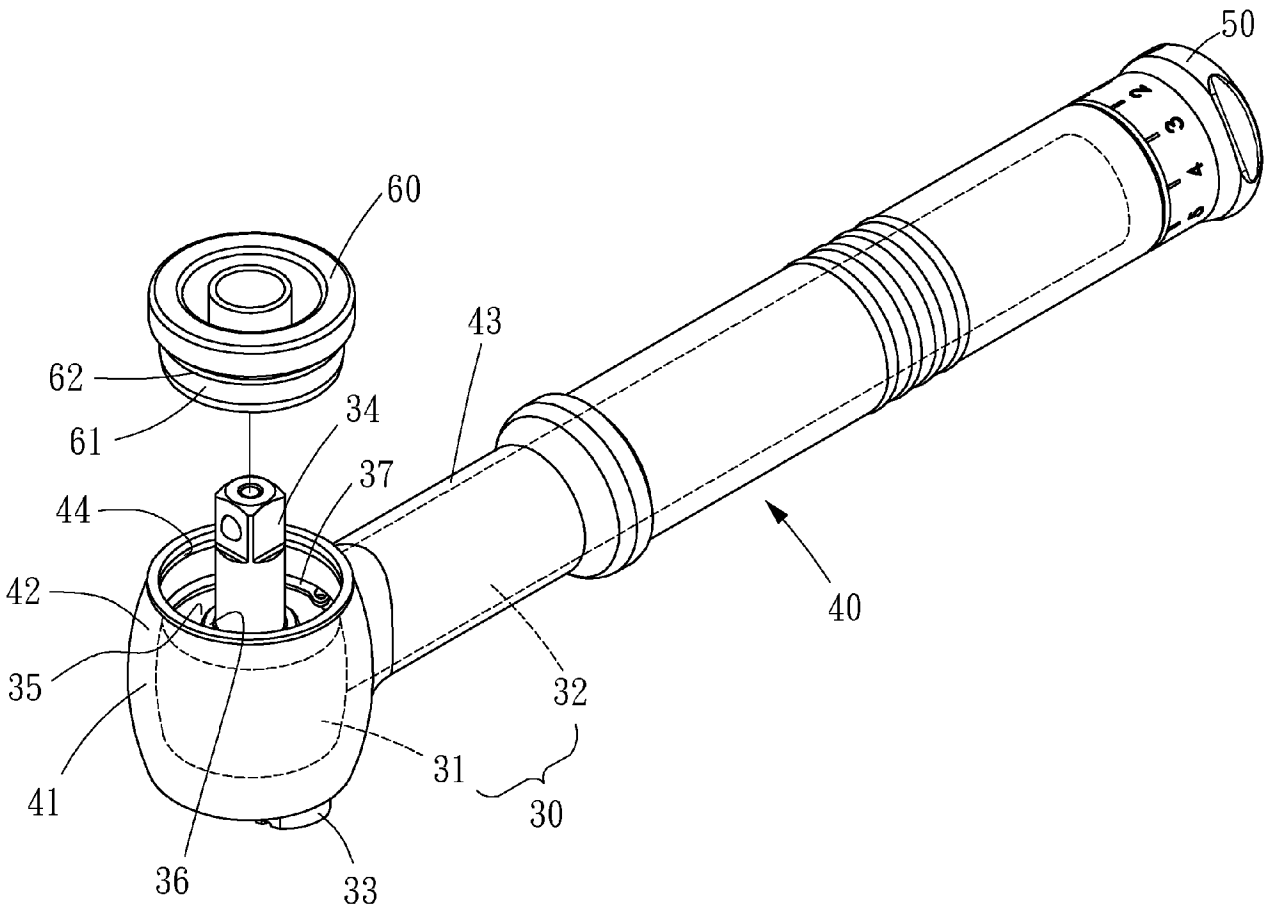
FIG. 2 is an exploded view of an isolative torque-exerting apparatus according to the preferred embodiment of the present invention.
Figure 3:
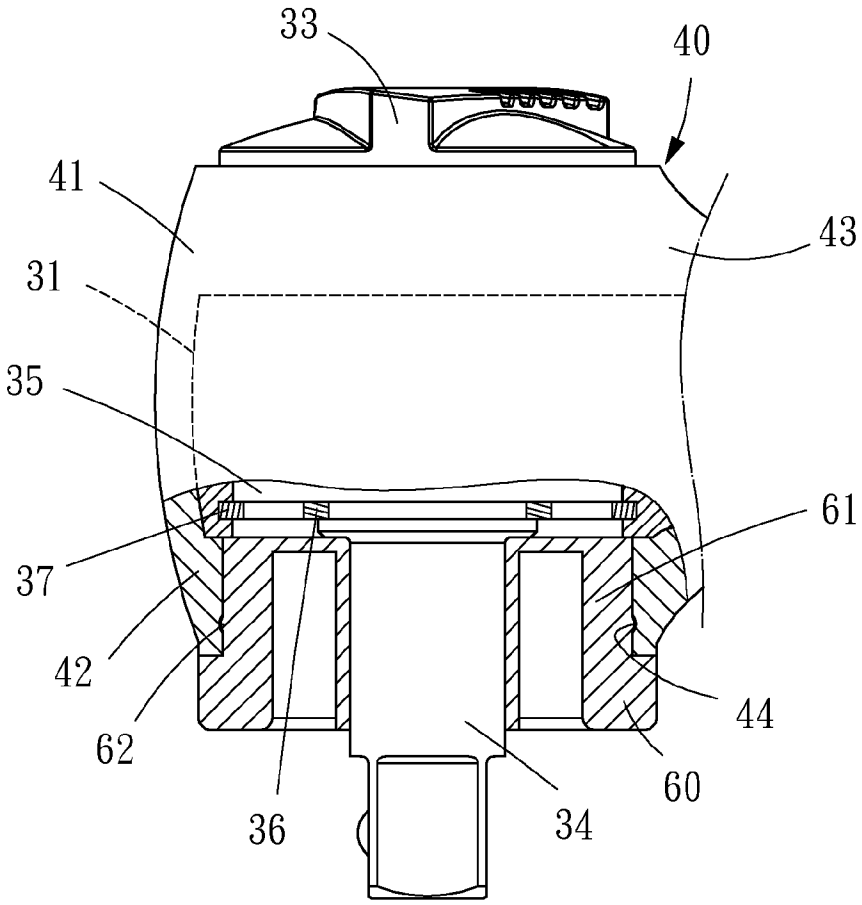
FIG. 3 is a cross-sectional view of the isolative torque-exerting apparatus shown in FIG. 2.

Referring to FIGS. 2 and 3, an isolative torque-exerting apparatus includes a wrench 30 and two isolating elements 40 and 60 according to the preferred embodiment of the present invention. The wrench 30 is wrapped by the isolating elements 40 and 60.

The head 31 includes a head 31, a handle 32, a switch 33, an insert 34, a ring 35 and two clips 36 and 37. The handle 32 extends from the head 31. The switch 33 is connected to a selective one-way mechanism (not shown) placed in the head 31. The insert 34 is connected to the selective one-way mechanism. The ring 35 is placed beneath the selective one-way mechanism. The clip 37 connected to the head 31 to keep the ring 35 in the head 31. The clip 36 is connected to the ring 35 to keep the insert 34 partially in the head 31.

To provide adequate strength, the head 31, the handle 32, the insert 34, the ring 35 and the clips 36 and 37 are made of metal for example. For isolation, the switch 33 is made of an isolative material such as plastics.

The isolating element 40 includes a cap 41, a skirt 42 and a sheath 43. The skirt 42 extends from the cap 41 along a first axis. An annular groove 44 is defined in an internal side of the skirt 42. The sheath 43 extends from the cap 41 along a second axis extending perpendicular to the first axis.

In use, the cap 41 wraps the head 31. The cap 41 does not interfere with the connection of the switch 33 to the head 31. The skirt 42 extends around but does not contact the insert 34. The skirt 42 does not interfere with the connection of the ring 35 and the clip 37 to the head 31.

The isolating element 60 includes two drums 61 and 66 and an annular membrane 65. The drums 61 and 66 and the annular membrane 65 are coaxial. The drums 61 and 66 extend for a same length. The annular membrane 65 extends to the drum 61 from the drum 66. An annular rib 62 extends on an external side of the drum 61.

In use, the drum 61 is inserted in the skirt 42. The annular rib 62 is fit in the annular groove 44 to keep the drum 61 in the skirt 42. The annular membrane 65 covers the ring 35 and the clips 36 and 37. The drum 66 wraps the insert 34, with the insert 34 allowed to rotate freely in the drum 66. The annular rib 62 can easily be moved out of the annular groove 44 to move the drum 61 out of the skirt 42 since the isolative material is flexible.

A knob 50 is connected to a torque-adjusting mechanism (not shown) placed in the handle 32. A maximum value of torque to be exerted with the wrench 30 is adjustable by the torque-adjusting mechanism operable via the knob 50.

The isolative torque-exerting apparatus exhibits several advantages over the prior art. At first, the skirt 42 and the drum 61 do not interfere with the connection of the clip 37 to the head 31. The internal diameter of the skirt 42 is larger than the internal diameter of the clip 37, thus rendering it easy to access to the clip 37 through the skirt 42. The annular rib 62 can easily be moved out of the annular groove 44 to move the drum 61 out of the skirt 42, thus rendering it easy to access to the clips 36 and 37 through the skirt 42. Hence, it is easy to detach the clips 36 and 37 from the head 31 and maintain the selective one-way mechanism.

Furthermore, the portion of the insert 34 that extends beyond the skirt 42 is substantially wrapped by the drum 66 and kept from any electric element. Hence, a user will not get an electric shock while working with the isolative torque-exerting apparatus in his or her hand.

Moreover, the clips 36 and 37 are protected from dust, dirt, grease and/or water since they are covered by the drum 66. Hence, the selective one-way mechanism may be contaminated or damaged by the dust, dirt, grease and/or water traveling into the head 31 past the clips 36 and 37.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An isolative torque-exerting apparatus including:

a wrench including a head, a handle extending from the head, a switch placed on the head, an insert partially inserted in the head, a ring placed against the insert, a first clip connected to the head for keeping the ring in the head, and a second clip connected to the ring for keeping the insert partially in the head;

a first isolating element including a cap for wrapping the head, a skirt extending from the cap, and a sheath for wrapping the handle; and a second isolating element including a first drum placed in the skirt, a second drum for wrapping the insert, and an annular membrane extending from the first drum to the second drum for covering the ring and the clips.

2. The isolative torque-exerting apparatus according to claim 1, wherein the skirt includes an annular groove defined therein, wherein the first drum includes an annular rib placed in the annular groove to keep the drum in the skirt.

3. The isolative torque-exerting apparatus according to claim 1, wherein the first and second drums extend for a same length.

4. The isolative torque-exerting apparatus according to claim 1, including a torque-adjusting knob placed on the handle.

* * * * *